United States Patent [19]

Learmont

[11] 4,082,358

[45] Apr. 4, 1978

[54] IN SITU SOLUTION MINING TECHNIQUE

[75] Inventor: Robert P. Learmont, Feeley Township, Itasca County, Minn.

[73] Assignee: United States Steel Corporation, Pittsburgh, Pa.

[21] Appl. No.: 654,310

[22] Filed: Feb. 2, 1976

[51] Int. Cl.[2] ..... E21B 43/28; E21C 41/14

[52] U.S. Cl. ..... 299/4; 166/245; 166/263

[58] Field of Search ..... 299/4; 166/245, 263

[56] References Cited

U.S. PATENT DOCUMENTS

| | | | |
|---|---|---|---|
| 3,309,140 | 3/1967 | Gardner et al. | 299/4 |
| 3,380,525 | 4/1968 | Altamira | 166/245 |
| 3,805,892 | 4/1974 | Haynes | 166/245 |
| 3,860,289 | 1/1975 | Learmont | 299/4 |
| 3,872,922 | 3/1975 | Altamira et al. | 166/245 |
| 3,903,966 | 9/1975 | Teasdale et al. | 166/245 |

*Primary Examiner*—Ernest R. Purser
*Attorney, Agent, or Firm*—William L. Krayer

[57] ABSTRACT

A method of in situ solution mining is disclosed in which a primary leaching process employing an array of 5-spot leaching patterns of production and injection wells is converted to a different pattern by converting to injection wells all the production wells in alternate rows.

7 Claims, 7 Drawing Figures

Ø - SHUT-IN INJECTION WELL

● - PRODUCTION WELL

◉ - FORMER PRODUCTION WELL CONVERTED TO INJECTION WELL

○ - INJECTION WELL
● - PRODUCTION WELL

Ø - SHUT-IN INJECTION WELL
● - PRODUCTION WELL
◉ - FORMER PRODUCTION WELL CONVERTED TO INJECTION WELL

IN SITU SOLUTION MINING TECHNIQUE

BACKGROUND OF THE INVENTION

During in situ leaching of uranium and other minerals, as the deposit approaches exhaustion, the concentration of uranium (or other elements of value) in the produced solution will decline to a level where the operation is no longer economically feasible. In most such operations it is advantageous to plan and operate the leaching operation in a manner such that the economic cutoff assay of the produced solution is not reached until a high percentage of the mineral or element of interest has been recovered.

A typical in situ leaching operation might consist of an array of 5-spot patterns, each pattern comprising a central production well and 4 corner injection wells. In a contiguous array of a multiplicity of such patterns the corner injection wells are usually common to all of the immediately adjacent patterns. Although diminished uranium (or other mineral) assay of the present solution is to be expected as the well patterns approach exhaustion, low assays also may result from dilution that occurs when part of the injected leachant flows directly to the production well via short and/or high-permeability paths that soon become barren of uranium. At the production well, the dilute solution mixes with uranium-bearing solution that has flowed through more circuitous and/or less permeable paths that do contain leachable uranium. There are at least two modes by which such preferential flow of leachant may occur: (1) the lateral permeability of various horizontal layers within the ore zone may be different, resulting in preferential flow of fluid through those layers that are most permeable, and (2) within any given layer having relatively uniform lateral (typically horizontal) permeability in all directions, flow will tend to be concentrated along the shortest path between the injection wells and the production well because this path has the shortest length and the highest pressure gradient. Mode 2 is shown graphically in FIG. 1.

Figure 2:
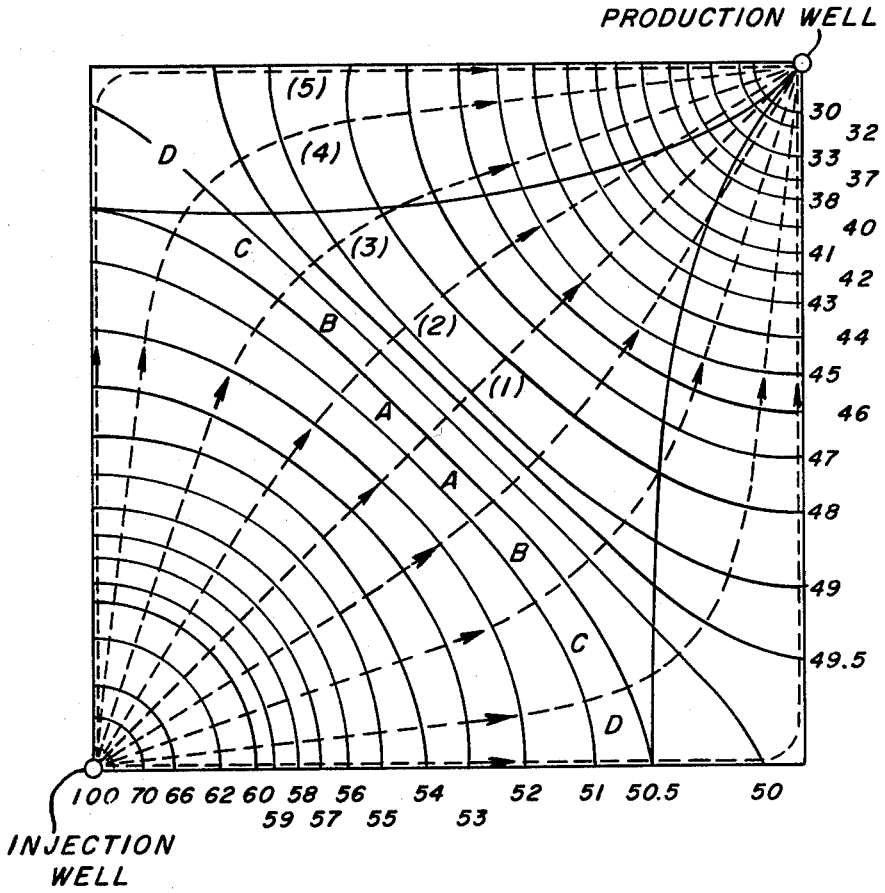

When preferential leaching entirely by the first mode occurs, there seems to be little that can be done about it presently. Although chemical injection to block off the more premeable layers can be considered, it entails the risk of blocking off ore zones and might considerably complicate efforts to purge objectionable solutions from the mineral zone after mining is terminated. If mode 1 leaching is not predominant, and the variations in lateral permeability over the vertical dimensions are not substantial, the pattern of flow suggests that there are certain areas which contain most of the remaining mineral. For example, FIG. 2 is a theoretical flow network of one quarter of an enclosed 5-spot pattern having uniform lateral permeability. By scaling from FIG. 2, a theoretical estimate has been made of pattern area represented by paths A, B, C, D, and the precentage of the total fluid that flows through each path.

| | A | B | C | D |
|---|---|---|---|---|
| % of Pattern Area | 21.4 | 24.5 | 29.8 | 24.3 |
| % of Fluid Flow | 30 | 30.6 | 25 | 14.4 |

Thus, about 25 percent of the uranium is present in those parts of the pattern area through which less than 15 percent of the leachant flows. Using these figures it is estimated that when paths A and B are exhausted some 22 percent of the original uranium will remain in areas represented by paths C and D, and the $U_3O_8$ concentration of the solution reaching the production well will be about 40 percent of what is was during the early stages of leaching. When paths A, B, and C are exhausted, $U_3O_8$ recovery will be about 93 percent but solution $U_3O_8$ assay will have diminished to less than 15 percent of its earlier value. As uranium recovery will be limited to whatever can be extracted before the solution concentration becomes too low for economic processing, it would be desirable to operate the patterns in a manner that will tend to keep solution concentration at a higher level. There is such a mode of operation.

The following U.S. patents have been found in a search performed on this subject:

| | |
|---|---|
| 3,863,987 | 2,919,909 |
| 2,952,449 | 3,654,866 |
| 3,718,366 | 3,841,705 |
| 3,779,601 | 3,713,698 |
| 3,709,295 | 3,647,261 |
| 3,606,465 | 3,442,553 |
| 3,309,141 | 2,954,218 |
| 3,309,140 | 2,818,240 |

It is believed that two of the references may be of special interest to the reader. These are Bays U.S. Pat. No. 2,952,449, and Livingston, U.S. Pat. No. 2,818,240. The Bays patent discloses a method for forming an underground communication between bore holes; however, the method involves the application of a hydraulic pressure to achieve a fracture of the formation. The removal of fracturing pressure from one hole and placing it on another hole in order to aid in the fracturing of a rock formation is not the same process or approach used by Applicant in his leaching process.

The Livingston U.S. Pat. No. 2,818,240, which is concerned with leaching, describes several different stages of leaching including a "flooding" stage and a "pressure leach" stage. Livingston uses a row by row approach, or the conversion of injection wells to production wells and/or vice versa; he does not close all of one type of well and convert only some of the others as does Applicant in the present case.

SUMMARY OF THE INVENTION

Figure 1:
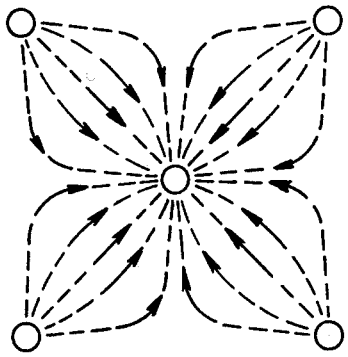
Figure 3:
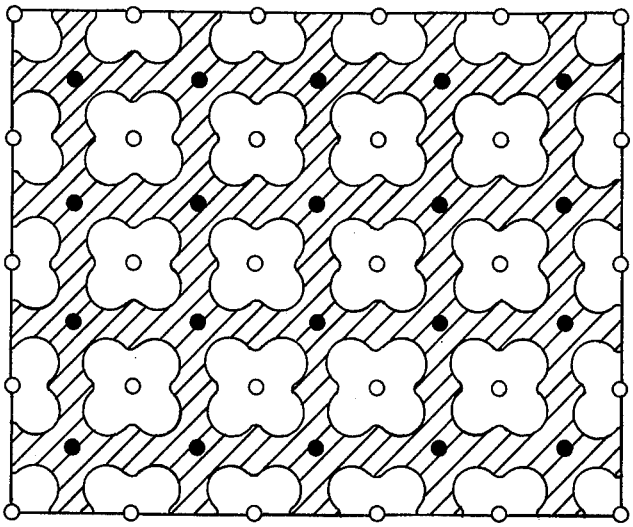
Figure 4:
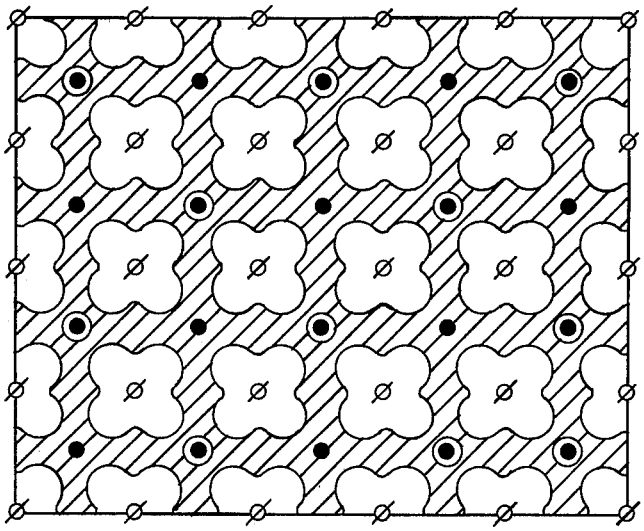
Figure 5:
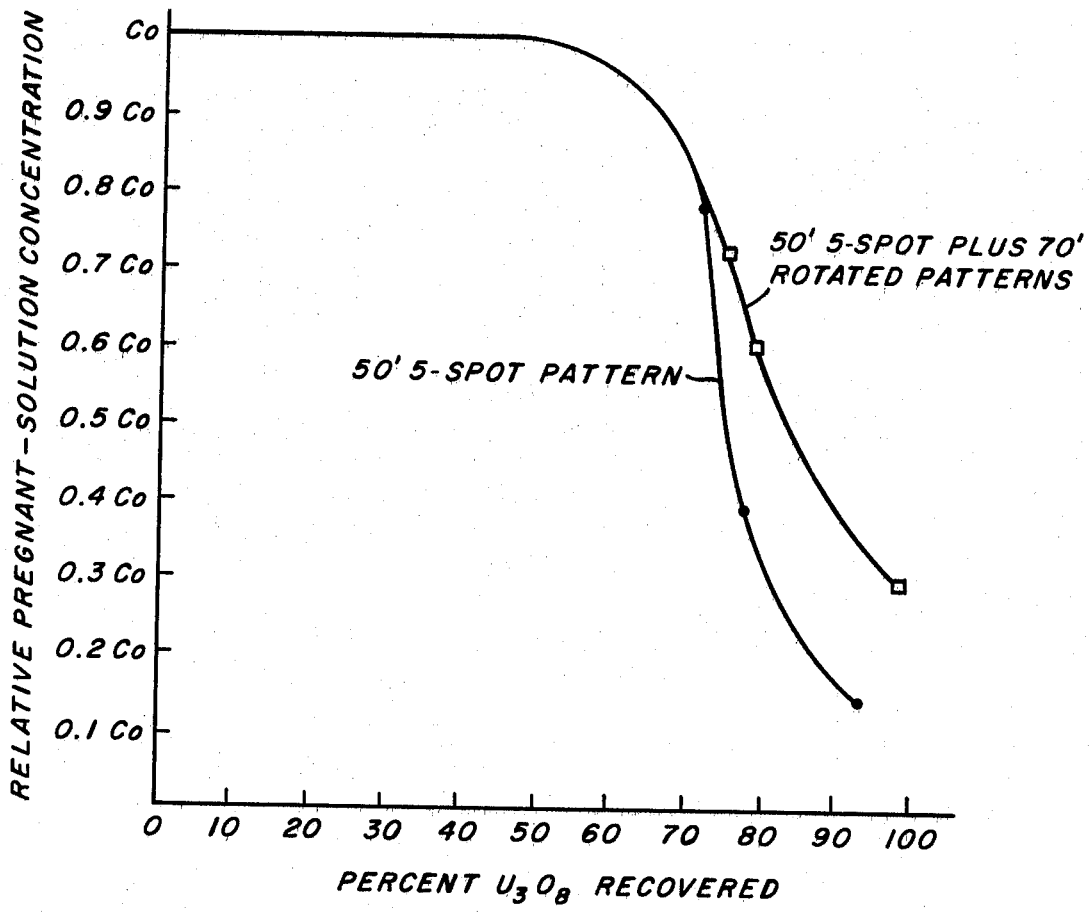

My invention will be illustrated partly through reference to the accompanying figures, in which FIG. 1 is a more or less diagrammatic representation of a 5-spot leach pattern, FIG. 2 is a theoretical flow pattern of one corner of a 5-spot configuration, FIG. 3 is an idealized illustration of the field after 50% extraction of the mineral, FIG. 4 shows the 50% leached field after conversion of some of the production wells according to a preferred mode of my invention, and FIG. 5 shows the improved recovery after conversion.

When mode 2 leaching predominates, alteration of the pattern layout at a time when $U_3O_8$ recovery is about 50% will result in obtaining higher overall extraction before reaching uneconomically low solution concentrations. For example, FIG. 3 is a portion of a large array of 50-foot-square back-to-back 5-spot patterns. The shaded areas indicate the most probable location of the uranium remaining after 50% of the uranium originally present has been extracted.

The leaching operation is more efficient if, at this stage, the operation is altered in a manner that results in preferential flow of leachant through those areas that still contain unleached uranium values. This can be accomplished without drilling additional wells by converting a particular half of the production wells to injection wells. As shown in FIG. 4, this results in a new array of 5-spot patterns whose axes are at 45° to those of the original array, and which will measure approximately 70 feet square compared to the original 50 feet square.

Using the flow net shown in FIG. 2, the approximate theoretical relationship between solution concentration and cumulative uranium extraction for two cases has been estimated. One case assumes the operation of confined 50-foot 5-spot patterns to exhaustion. The other case assumes operation of the confined 5-spot patterns to about 50% of $U_3O_8$ extraction and then converting the array to the 45°, rotated 70-foot, 5-spot configuration with all the original injection wells shut down, the preferred practice. The indicated relationship between solution concentration and cumulative uranium recovery for these two modes of operation is shown in FIG. 5. The results indicate that economic operation to a higher percentage of uranium recovery may be accomplished by the conversion to the 45-degree rotated configuration at about 50% extraction. It should be pointed out that because the area of a rotated 70-foot pattern is twice that of a 50-foot pattern, the number of 70-foot patterns produced after the rotation has occurred will be only half the number of 50-foot patterns that were operating prior to the rotation. The reduced number of patterns would probably result in a lower rate of extraction (as gpm per acre), but in an active mining operation this should pose no problem.

Figure 6:
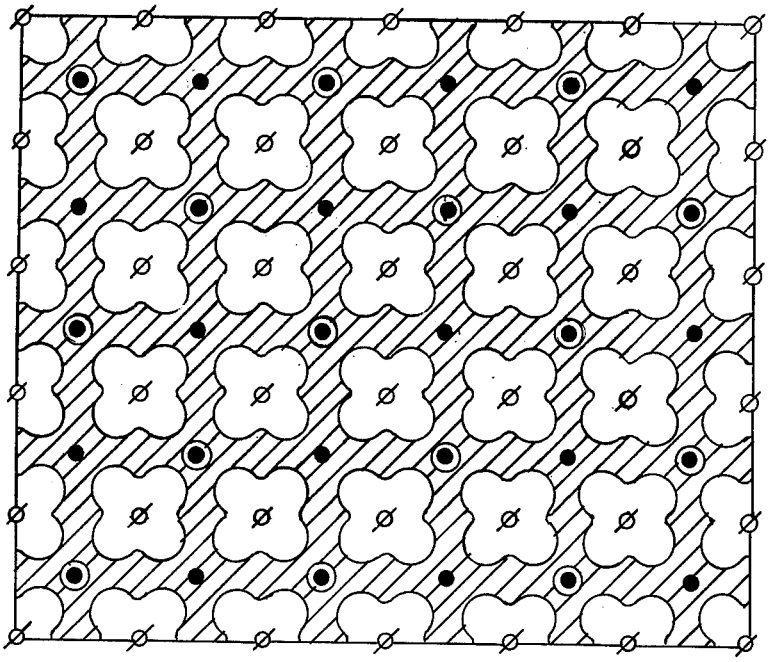
Figure 7:
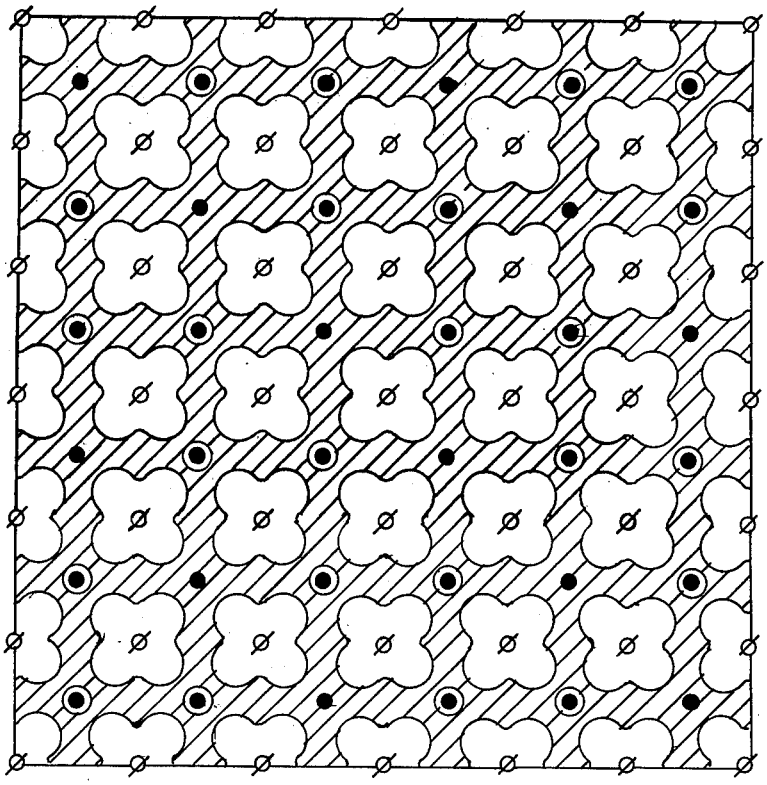

Referring to FIGS. 6 and 7, my invention may be varied so that hexagonal leaching patterns are formed; in FIG. 6, which shows only the original production wells, the hexagonal pattern of wells converted to injection wells contains one production well for each hexagon, while the variation of FIG. 7 contains two.

It will be apparent to persons skilled in the art that my invention is applicable to water-flooding operations in the secondary recovery of oil, whether or not polymers are employed. That is, where a 5-spot water flooding pattern has been used, the injection wells may be closed and a portion of the production wells converted to injection wells in patterns identical to those herein described or in any other new pattern.

My invention is not limited to the above particular example but may be otherwise practiced within the scope of the following claims.

I claim:

1. Method of establishing a secondary production pattern for in situ leaching of mineral values from a formation wherein a primary leaching process has been conducted through an array of contiguous 5-spot leaching patterns of production wells and injection wells, comprising converting all the production wells in alternate rows diagonal to the original pattern to injection wells.

2. Method of claim 1 including the step of shutting down all the injection wells of the primary leaching process.

3. Method of in situ leaching of mineral values to exhaustion from a formation wherein a primary leaching process has been conducted through an array of contiguous 5-spot leaching patterns of production wells and injection wells, comprising converting all the production wells in alternate rows diagonal to the original pattern to injection wells, and injecting a leaching solution through the new injection wells.

4. Mehtod of claim 3 including the step of shutting down all the injection wells of the primary leaching process.

5. Method of establishing a secondary production pattern for in situ leaching of mineral values from a formation wherein a primary leaching process has been conducted through an array of contiguous 5-spot leaching patterns of production wells and injection wells, comprising closing all of the injection wells of the primary leaching process and converting production wells to injection wells in a contiguous hexagonal leaching pattern.

6. Method of establishing a secondary production pattern for in situ leaching of $U_3O_8$ values from a formation wherein a primary leaching process has been conducted through an array of contiguous 5-spot leaching patterns of production wells and injection wells until the $U_3O_8$ recovery is at a rate about 50% of the initial recovery rate, comprising converting all the production wells in alternate rows diagonal to the original pattern to injection wells.

7. Method of in situ leaching of $U_3O_8$ values to exhaustion from a formation wherein a primary leaching process has been conducted through an array of contiguous 5-spot leaching patterns of production wells and injection wells until the $U_3O_8$ recovery is at a rate about 50% of the initial recovery rate, comprising converting all the production wells in alternate rows diagonal to the original pattern to injection wells, and injecting a leaching solution through the new injection wells.

* * * * *

UNITED STATES PATENT OFFICE

CERTIFICATE OF CORRECTION

Patent No. 4,082,358 Dated April 4, 1978

Inventor(s) Robert P. Learmont

It is certified that error appears in the above-identified patent and that said Letters Patent are hereby corrected as shown below:

Column 1, line 21, change "present" to -- pregnant --.

Column 2, line 3, change "is" to -- it --.

Signed and Sealed this

*Third* Day of *October 1978*

[SEAL]

*Attest:*

RUTH C. MASON
*Attesting Officer*

DONALD W. BANNER
*Commissioner of Patents and Trademarks*